United States Patent [19]

Monckton et al.

[11] 4,301,962

[45] Nov. 24, 1981

[54] STRAIGHT LINE GLUED FOLDER

[75] Inventors: Lewis P. Monckton, Addison; John J. Austin, LaGrange both of Ill.

[73] Assignee: Champion International Corporation, Stamford, Conn.

[21] Appl. No.: 130,234

[22] Filed: Mar. 14, 1980

[51] Int. Cl.[3] ..... B65D 27/08

[52] U.S. Cl. ..... 229/72; 229/1.5 R; 229/DIG. 3; 40/124.2; 40/124.4; 40/359

[58] Field of Search ..... 229/721.5 R, DIG. 3; 40/124.2, 124.4, 359; 150/39; 206/215

[56] References Cited

U.S. PATENT DOCUMENTS 3,870,223 3/1975 Wyant ..... 229/1.5 R X 4,109,850 8/1978 Meenan et al. ..... 229/72

*Primary Examiner*—George T. Hall

*Attorney, Agent, or Firm*—Evelyn M. Sommer

[57] ABSTRACT

A folder constructed from a one-piece paperboard blank contains two inner opposed pocket enclosures, for example, for the storage of payment cards and the like. The folder includes an outer panel having a die-cut window through which information may be displayed and a spinal region in which premium items may be positioned.

8 Claims, 3 Drawing Figures

STRAIGHT LINE GLUED FOLDER

BACKGROUND OF THE INVENTION

The present invention relates to paperboard folders, such as cardboard folders, and more particularly to an economical paperboard folder which may be used to organize materials such as payment cards and pre-addressed envelopes.

Since the possibility exists for a lack of order when dealing with matters such as the regular payment of loans or bills, a folder may allow for the organization of payment slips and envelopes.

Banks and other such businesses dealing with loans and other forms of time payment may send these folders to their clients in order to aid their convenience in making payments as well as to assure speedy and regular monthly payments.

SUMMARY AND OBJECTIVES OF THE INVENTION

The present invention provides a one-piece flattened folder constructed from material such as paperboard. The construction allows for relatively low-cost production using conventional machinery and permits ease of shipment. For example, when the folder along with its contents is sent to a customer, the folder may be placed in an outer enclosure, for example, an envelope. The folder has a die-cut window exposing the client's name and address which may be aligned with a similar opening on the front of the enclosure envelope. Pocket enclosures are located inside the folder on opposing inner member panels. For example, the pockets may be used for the storage of payment cards in one pocket and pre-addressed payment envelopes in the other. The spinal area of the folder may contain a premium item, for example, a pen or a pencil.

It is an objective of the present invention to provide a paperboard folder with inner pocket enclosures for the organization and display of two groups of items, for example, payment cards and pre-addressed payment envelopes.

It is a further objective of the present invention to provide such a folder with a die-cut window in order to display the address and name of client, for example, when a payment card is placed in the pocket.

It is a further objective of the present invention to provide such a folder with a spinal area to permit the retention of a premium item.

It is a further objective of the present invention to provide such a paperboard folder which will be relatively economical to manufacture.

BRIEF DESCRIPTION OF THE DRAWINGS

Other objectives of the present invention will be apparent from the following detailed description of the inventor's best mode of practicing the invention. The detailed description should be taken in conjunction with the accompanying drawings.

Figure 1:
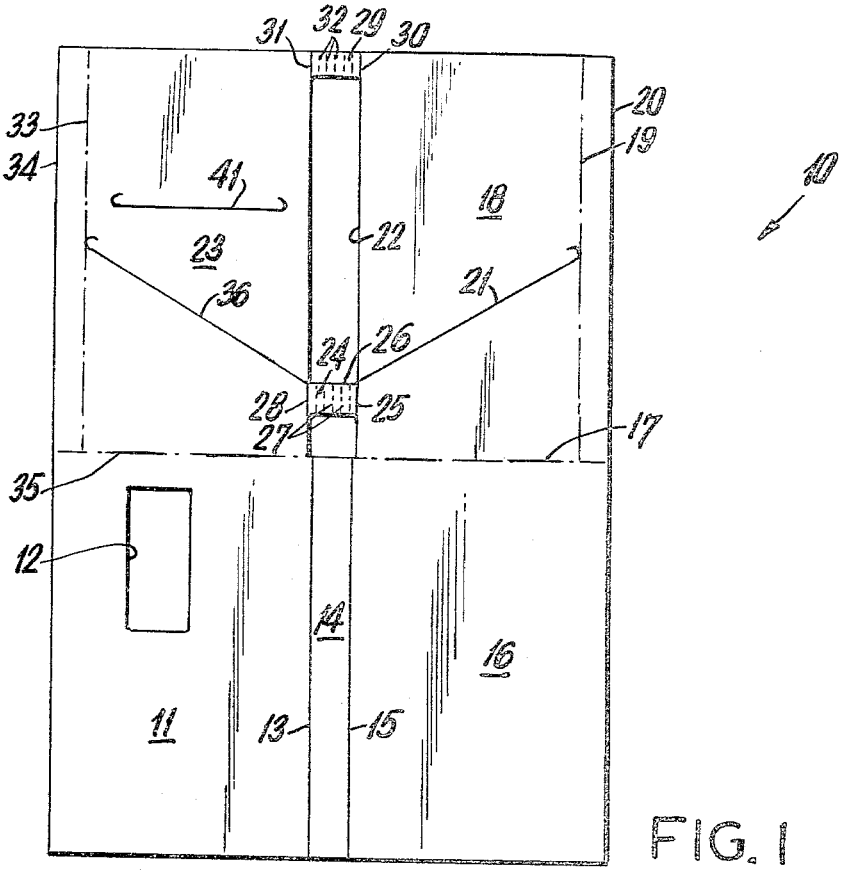
Figure 2:
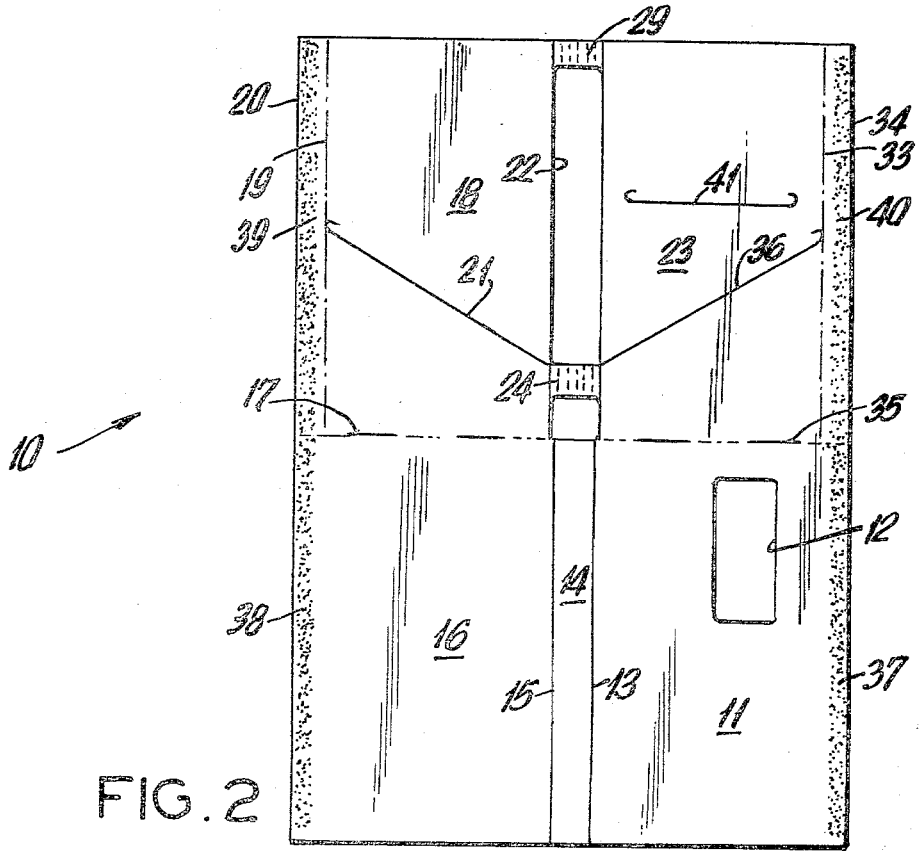

IN THE DRAWINGS:

FIG. 1 is a top plan view of the one-piece cardboard blank of the present invention;

FIG. 2 is a bottom plan view of the blank shown in FIG. 1; and

Figure 3:
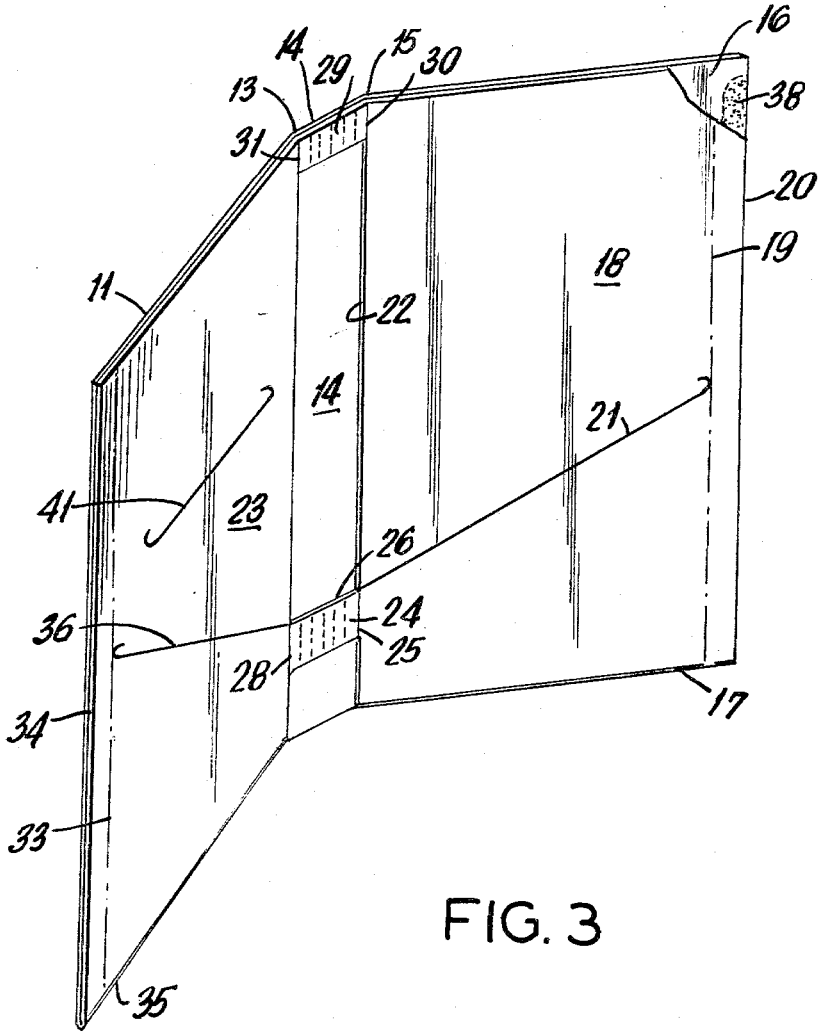

FIG. 3 is a perspective view of the folder of the present invention which is formed after the blank of FIGS. 1 and 2 has been folded and glued.

DETAILED DESCRIPTION OF THE INVENTION

As shown in FIG. 1, the straight-line glued no-depth folder of the present invention is constructed from a one-piece paperboard blank 10 which may be, for example, of cardboard. In the drawing the solid lines represent cut lines or edges and the dash lines represent fold lines.

The blank 10 includes a first rectangular outer member panel 11 having a die-cut window (orifice) 12. The window 12 is preferably rectangular with rounded corners and is of a suitable size to display the name and address of a client. The blank 10, as seen in FIG. 1, has a top and bottom side, with the top side being illustrated in FIG. 1 and the bottom side in FIG. 2.

The top side of the blank 10 is printed; for example, the rectangle 11 may have the name of the company to whom payments are made and a printed statement, "Here's all you need to send your monthly payments." The panel 11 is connected by a fold line 13 to an elongated rectangular spinal panel 14. The spinal panel 14, in turn, is connected by a fold line 15 to the second outer member panel 16. The panels 11 and 16 and the spinal panel 14 are called outer member panels since they are on the outside of the folder after the folder has been glued. The rectangular outer member panel 16 is of the same size and shape as the outer member panel 11.

The outer member panel 16 is connected by a fold line 17 to a rectangular inner member panel 18 which is of the same size and shape as the panel 16. The outer member panel 18 has a fold line 19 parallel to its exterior edge 20. A die-cut line 21 is cut through the panel 18 at an angular (diagonal) relationship to the fold line 17 and crosses the portion of the panel 18 between its inner edge 22 and the fold line 19.

Two bridging members 24,29 are connected between the inner member (internal) panel 18 and its opposite inner member panel 23. The first bridging member 24 is connected by fold line 25 to the panel 18 with the outer edge 26 of the briding member 24 touching the end of the cut line 21. The bridging member 24 has a series of parallel fold lines 27, there being preferably five of such fold lines. The bridging member 24 is connected by a fold line 28 to the panel 23.

A second bridging member 29 is connected by a fold line 30 to the panel 18 and connected by fold line 31 to the panel 23. It also has a series of parallel fold lines 32, there being preferably five of such internal fold lines within the bridging member 29. The inner member panel 23 includes a fold line 33 which is parallel to its external edge 34. The inner member panel 23 is connected to the first external outer member panel 11 by the fold line 35. Panel 23 has a cut slit 41 parallel to fold line 35.

As shown in FIG. 2, the outer edges of the panels 11,16,18,23 have elongated glue line areas, respectively areas 37, 38, 39,40. The glue areas 39 and 38, and the opposite glue areas 37,40, have an adhesive applied thereto for ease of manufacture, although only one glue line area on each side, such as 39 and 40, may require such an adhesive.

In assembling the folder, the blank 10 is folded along fold lines 17,35, the glue area 39 is adhered to the glue area 38, and the glue area 40 is adhered to the glue area 37.

The glued folder is shown in FIG. 3. It may be used by inserting pre-addressed envelopes in slits 36 and 41 with the payor's name showing through window 12. The payment slips may be inserted in slit 21 and a premium item may be held in the spinal area, formed by spinal panel 14, by means of one or both of the bridging members 24,29.

What is claimed is:

1. A one-piece paperboard blank to form a straight line glued no-depth folder comprising:

an outer member portion including first and second rectangular panels, a spinal fold line at the edge of each of said first and second panels, a rectangular spinal panel connected between said first and second panels by said spinal fold lines, a window within said first panel for displaying information, an inner member portion including first and second rectangular panels respectively connected to said respective first and second outer member panels by panel fold lines perpendicular to said spinal fold lines, a slit in each of said first and second inner member portion panels, said slits being diagonally opposite to one another, a horizontal slit in said first inner member panel parallel to said panel fold line, a bridging panel between said inner member panels and connected to said inner member panels by fold lines for strengthening and to form a spinal area to hold a premium item, and glue lines on the bottom side of a said blank along the edges of at least two of the opposite rectangular panels to thereby form the folder by adhering the edge area of the first inner member panel to the edge area of the first outer member panel and the outer edge area of the second inner member panel to the edge area of the second outer member panel.

2. A blank as in claim 1 and further comprising a fold line on each of said inner member panels parallel to each other and to the edges of said panels, thereby helping to prevent said diagonal slits from tearing through to the edges.

3. A blank as in claim 2 and further comprising a second bridging panel between said interior member panels and connected to them by fold lines.

4. A blank as in claim 3 wherein said bridging panels have a plurality of fold lines parallel to the fold lines connecting them to said interior member panels.

5. A one-piece paperboard straight line glued no-depth folder comprising:

an outer member portion including first and second rectangular panels, a spinal fold line at the edge of each of said first and second panels, a rectangular spinal panel connected between said first and second panels by said spinal fold lines, a window within said first panel for displaying information, an inner member portion comprising first and second rectangular panels respectively connected to said respective first and second outer member panels by panel fold lines perpendicular to said spinal fold lines, a slit in each of said first and second inner member portion panels, said slits being diagonally opposite to one another, a horizontal slit in said first inner member panel parallel to said panel fold line, a bridging panel between said inner member panels and connected to said inner member panels by fold lines for strengthening and to form a spinal area to hold a premium item, and glue lines adhering the edge area of the first inner member panel to the edge area of the first outer member panel and the edge area of the second inner member panel to the edge area of the second outer member panel.

6. A folder as in claim 5 and further comprising a fold line on each of said inner member panels parallel to each other and to the edges of said panels, thereby helping to prevent said diagonal slits from tearing through to the edges.

7. A folder as in claim 5 and further comprising a second bridging panel between said interior member panels and connected to them by fold lines.

8. A folder as in claim 7 wherein said bridging panels have a plurality of fold lines parallel to the fold lines connecting them to said interior member panels.

* * * * *